US008975816B2

(12) United States Patent
Scheitrum et al.

(10) Patent No.: US 8,975,816 B2
(45) Date of Patent: Mar. 10, 2015

(54) MULTIPLE OUTPUT CAVITIES IN SHEET BEAM KLYSTRON

(75) Inventors: Glenn P. Scheitrum, San Mateo, CA (US); George Caryotakis, El Dorado Hills, CA (US)

(73) Assignee: Varian Medical Systems, Inc., Palo Alto, CA (US)

( * ) Notice: Subject to any disclaimer, the term of this patent is extended or adjusted under 35 U.S.C. 154(b) by 1108 days.

(21) Appl. No.: 12/436,049

(22) Filed: May 5, 2009

(65) Prior Publication Data

US 2013/0015763 A1 Jan. 17, 2013

(51) Int. Cl.
*H01J 25/10* (2006.01)
*H01J 23/38* (2006.01)

(52) U.S. Cl.
CPC *H01J 23/38* (2013.01); *H01J 25/10* (2013.01)
USPC ..... 315/5.39; 315/505; 315/506; 315/5.29; 315/5.16

(58) Field of Classification Search
USPC ..... 315/5, 5.35, 5.37–5.39, 41, 500, 501, 315/506, 5.42, 5.29, 505, 5.51; 313/3, 153, 313/154, 421; 250/396 R, 423 R
See application file for complete search history.

(56) References Cited

U.S. PATENT DOCUMENTS 2,822,541 A 2/1958 Sichak et al.
3,038,086 A 6/1962 Sterzer
4,733,131 A * 3/1988 Tran et al. ..... 315/5.14
5,461,282 A 10/1995 Scheitrum
5,521,551 A * 5/1996 Ferguson ..... 330/45
5,646,585 A 7/1997 Suzuki et al.
5,691,602 A 11/1997 Suzuki
5,698,949 A * 12/1997 Lien et al. ..... 315/5.31
5,838,107 A * 11/1998 Beunas et al. ..... 315/5.16
6,326,730 B1 * 12/2001 Symons ..... 315/5.39
7,206,379 B2 * 4/2007 Lemaitre ..... 378/122

(Continued)

FOREIGN PATENT DOCUMENTS

GB 2 280 542 A 2/1995
JP 2004-253227 A 9/2004

(Continued)

OTHER PUBLICATIONS

International Search Report and Written Opinion dated Jul. 19, 2010 for PCT/US2010/033702.

(Continued)

*Primary Examiner* — Douglas W Owens
*Assistant Examiner* — Amy Yang
(74) *Attorney, Agent, or Firm* — Vista IP Law Group, LLP

(57) ABSTRACT

A RF generator includes a structure having an input section, an output section, and an opening extending between the input section and the output section, wherein the output section has a first cavity and a second cavity, and wherein the first and second cavities are spaced apart from each other so that they are electromagnetically uncoupled from each other. A method of providing RF energy, includes receiving an electron beam, providing a first RF energy through a first cavity, wherein the first RF energy is generated using the electron beam, and providing a second RF energy through a second cavity, wherein the second RF energy is generated using the electron beam, wherein the first cavity and the second cavity are spaced apart from each other so that they are electromagnetically uncoupled from each other.

37 Claims, 8 Drawing Sheets

(56) References Cited

U.S. PATENT DOCUMENTS

| | | | | |
|---|---|---|---|---|
| 7,385,354 | B2 * | 6/2008 | Miyake | 315/5.39 |
| 7,619,374 | B2 * | 11/2009 | Aoi et al. | 315/500 |
| 8,076,853 | B1 * | 12/2011 | Caryotakis | 315/5 |
| 2006/0158382 | A1 | 7/2006 | Nagai | |
| 2007/0139287 | A1 | 6/2007 | Inomata et al. | |
| 2008/0100384 | A1 * | 5/2008 | Miyake | 331/6 |

FOREIGN PATENT DOCUMENTS

| | | | |
|---|---|---|---|
| WO | 93-23867 | A1 | 11/1993 |
| WO | 9738437 | A1 | 10/1995 |
| WO | 9738436 | A1 | 10/1997 |
| WO | WO 9738436 | A1 * | 10/1997 |
| WO | 2008109064 | A1 | 12/2008 |

OTHER PUBLICATIONS

International Preliminary Report on Patentability for PCT/US2010/033702.

Extended European Search Report dated Apr. 17, 2014 for related EP Patent Application No. 10772758.8.

G. Scheitrum, "Design and Construction of a W-band Sheet Beam Klystron", Contributed to 7th Workshop on High Energy Density and High Power RF, Jun. 13-17, 2005, Kalamata, Greece.

International Preliminary Report on Patentability for PCT/US2010/033702, Jul. 2010.

* cited by examiner

Comparison between round and sheet beams

CURRENT DENSITY AND FOCUSING MAGNETIC FIELD FOR NLC KLYSTRONS

Frequency = 11.4 GHz

Beam Current = 257 A

Beam Voltage = 490 kV

Power Output = 75 MW

SBK

2a = 1.2 cm

2b = 0.8 cm

W = 10 cm

D = .12 cm

J = 32 A/cm²

B = 300 Gauss

XP3

2a = 0.95 cm

2b = 0.62 cm

J = 1060 A/cm²

B = 2500 Gauss

MULTIPLE OUTPUT CAVITIES IN SHEET BEAM KLYSTRON

FIELD

This application relates generally to radio-frequency (RF) source, such as a klystron, and more specifically, to klystron that generates a sheet beam.

BACKGROUND

A klystron is a device that converts the kinetic energy of a direct current (DC) electron beam into radiofrequency (RF) energy. Klystrons have been used in a variety of applications. For example, klystron may be used to provide RF energy to a particle accelerator, such as an electron accelerator, to cause the accelerator to generate a particle beam with a certain desired characteristic. In some cases, the particle beam may be used to produce a radiation beam for treatment or diagnostic purpose. Klystrons may also be used to produce reference signals for superheterodyne radar receivers, and high-power carrier waves for communications.

A klystron may include an electron gun, two or more resonant cavities through which the electron beam propagates, and a collector which captures the spent electron beam and dissipates the resultant heat. The simplest klystron has two cavities—an input cavity and an output cavity. In the input cavity, microwave energy excites the cavity resonance. The resultant electric field that is produced in the beam tunnel modulates the DC electron beam. In one half period of the RF wave, the electrons lose energy from the electric field in the resonator and decrease velocity. In the next half period, the electrons gain energy and increase in velocity. The change in velocity is small but the sinusoidal variation in beam velocity causes the electrons to bunch together and produce a sinusoidally varying RF beam current.

The output cavity of the klystron may be situated at the position along the beam path where the RF current has reached a desired value, e.g., a maximum value. As the electron bunches pass through the output cavity, they induce currents on the surface of the cavity walls, which in turn produce a resonant mode in the output cavity. The resonant mode produces an electric field that decelerates the electron bunches and converts the electron beam kinetic energy into RF energy. The RF energy is then coupled out from an output cavity at the resonator. In some cases, additional resonant cavities may be placed between the input and output cavity to increase the gain of the klystron, or to modify the frequency response and bandwidth of the device.

Existing klystrons produce a cylindrical electron beam with a circular cross section that propagates down a cylindrical beam tunnel and interacts with resonant cavities that are figures of revolution. However, Applicants determine that it may be desirable to have klystrons that produce an electron beam with an elongate cross section. In addition, Applicants determine that it may be desirable to provide more than one output cavities at the klystron that are uncoupled from each other.

SUMMARY

In accordance with some embodiments, a RF generator includes a structure having an input section, an output section, and an opening extending between the input section and the output section, wherein the output section has a first cavity and a second cavity, and wherein the first and second cavities are spaced apart from each other so that they are electromagnetically uncoupled from each other.

In accordance with other embodiments, a method of providing RF energy, includes receiving an electron beam, providing a first RF energy through a first cavity, wherein the first RF energy is generated using the electron beam, and providing a second RF energy through a second cavity, wherein the second RF energy is generated using the electron beam, wherein the first cavity and the second cavity are spaced apart from each other so that they are electromagnetically uncoupled from each other.

Other and further aspects and features will be evident from reading the following detailed description of the embodiments, which are intended to illustrate, not limit, the invention.

BRIEF DESCRIPTION OF THE DAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DESCRIPTION OF THE EMBODIMENTS

Figure 1:
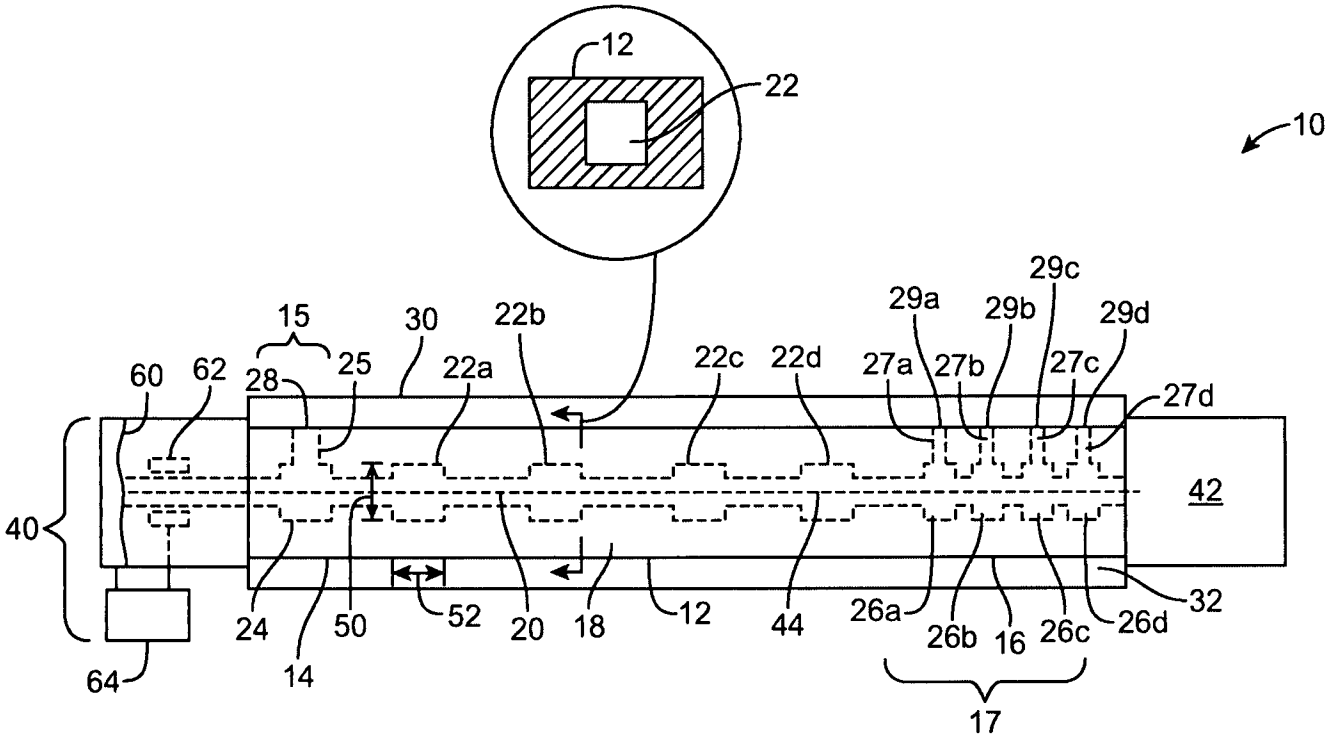
FIG. 1 illustrates a klystron in accordance with some embodiments.

Various embodiments are described hereinafter with reference to the figures. It should be noted that the figures are not drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated.

FIG. 1 illustrates a klystron 10 in accordance with some embodiments. As used in this specification, the term "klystron" may refer to any device that is capable of converting a kinetic energy of a DC electron beam into energy, such as RF energy. The klystron 10 may be a linear-beam vacuum tube for use as an amplifier at microwave or radio frequencies to produce a driving force for a device, such as a particle accelerator. However, in other embodiments, the klystron 10 may be configured to operate in any frequency, such as W-band, X-band, S-band, L-band, etc. Thus, the term "klystron" should not be limited to any particular operating frequency or range of operating frequencies. In other embodiments, the klystron 10 may be used to produce low-power reference signals for superheterodyne radar receivers. In further embodiments, the klystron 10 may be used to produce high-power carrier waves for communications. In further embodiments the klystron may be used as a power source to provide energy for material processing, curing of materials, or cooking.

As shown in the figure, the klystron 10 includes a structure 12 having a first end 14 with an input section 15, a second end 16 with an output section 17, and a body 18 extending between the ends 14, 16. As used in this specification, the term "input section" may refer to any part of the klystron 10 that includes a component for receiving energy. Similarly, as used in this specification, the term "output section" may refer to any part of the klystron 10 that includes a component for outputting energy. The structure 12 also includes an opening 20 extending between the ends 14, 16, and a plurality of intermediate cavities 22*a*-22*d* arranged in series. Although only four intermediate cavities 22 are shown in the illustrated embodiments, in other embodiments, the klystron 10 may include less than four intermediate cavities 22 or more than four intermediate cavities 22. In the illustrated embodiments, the resonant cavities 22 are waveguide sections operating at cutoff frequency. Each of the cavities 22 is separated from an adjacent cavity 22 by a drift space area. In the illustrated embodiments, each cavity 22 has an elongate (e.g., rectangular) cross section. The vertical extent 50 of the cavity's cross section is larger than the horizontal extent 52, and therefore the resonant frequency of the cavity 22 is determined by the vertical extent 50. In other embodiments, each cavity 22 may have other cross sectional shapes.

An input cavity 24 is provided at the input section 15, which includes an input 25 (e.g., in a form of a passage way) formed by part of the structure 12 for directing/coupling energy into the input cavity 24 through an opening 28. Also, a plurality of output cavities 26*a*-26*d* are provided at the output section 17, which includes a plurality of outputs 27*a*-27*d* (each in a form of a passage way) formed by part of the structure 12 for directing/coupling energy out of the output cavities 26*a*-26*d*, respectively, through openings 29*a*-29*d*. In some cases, the lumen in each output 27 may be considered to be a part of the corresponding output cavity 26, in which case, the output cavity 26 would include the space of the output 27. In the illustrated embodiments, the input section 15 is at the first end 14, and the output section 17 is at the second end 16. In other embodiments, the input section 15 and the output section 17 may be located at other positions.

The klystron 10 also includes a first magnetic structure 30 and a second magnetic structure 32 located above and below, respectively, the structure 12. Each of the magnetic structures 30, 32 includes a plurality of magnets and polepieces (e.g., iron bars) arranged in a series along the length of the structure 12 in an alternating manner. The magnetic structures 30, 32 are configured to provide magnetic field along the length of the structure 12 to thereby confine an electron beam inside the structure 12.

The klystron 10 also includes an electron source 40 (e.g., an electron gun) coupled to the first end 14 of the structure 12, and a collector 42 coupled to the second end 16 of the structure 12. The electron source 40 is configured to provide an electron beam 44, which enters into the opening 20 of the structure 12. The electron beam 44 is used to produce DC energy, which is converted to RF energy and coupled out from the output cavities 26*a*-26*d*. The collector 42 is configured to collect spent electron beam, with reduced energy. In some embodiments, the collector 42 may be a depressed collector, which recovers energy from the beam before collecting the electrons.

Figure 2:
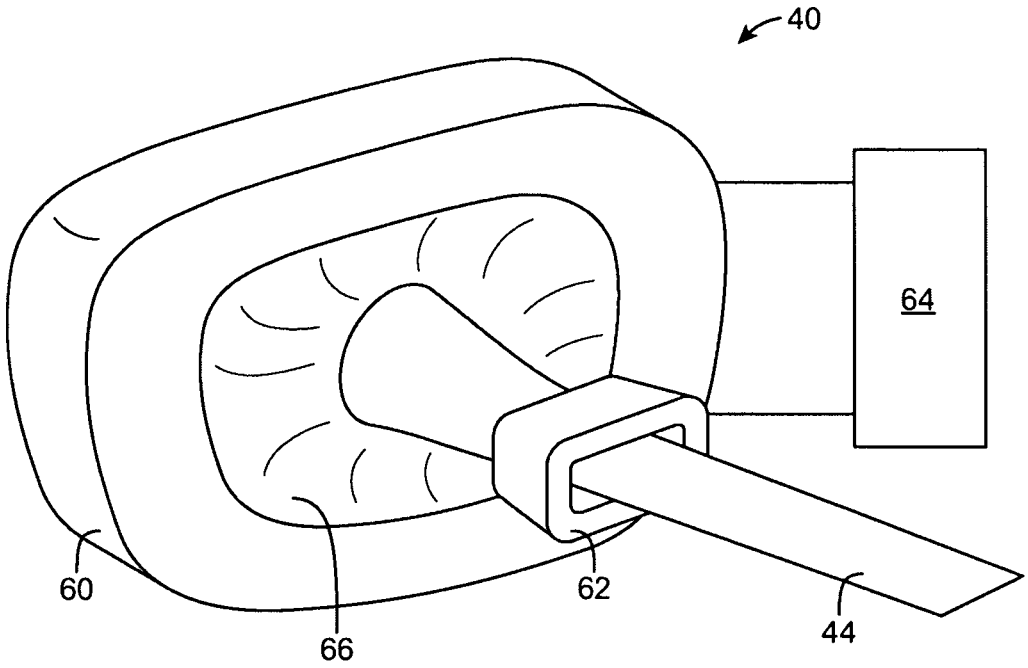
FIG. 2 illustrates an electron source in accordance with some embodiments.

FIG. 2 illustrates the electron source 40 in accordance with some embodiments. The electron source 40 includes a cathode 60, an anode 62, and a voltage generator 64 coupled to the cathode 60 and the anode 62. During use, the voltage generator 64 provides a differential voltage between the cathode 60 and the anode 62, thereby generating the electron beam 44. As shown in the figure, the anode 62 has an elongate opening 68, and the cathode 60 has a track 66 that is longer in one direction than in an orthogonal direction. Such configuration allows a beam with an elongate cross section to be produced. As used in this specification, the term "elongate" refers to any shape, such as a rectangle, an ellipse, etc., in which one dimension of the shape measured in one direction is longer than another dimension of the shape measured in another direction that is orthogonal to the first direction. Similarly, the term "sheet beam" should not be limited to a beam having a sheet-like configuration, and may refer to any beam with an elongate cross section in which one dimension measured in one direction is longer than another dimension measured in another direction that is orthogonal to the first dimension.

Figure 3:
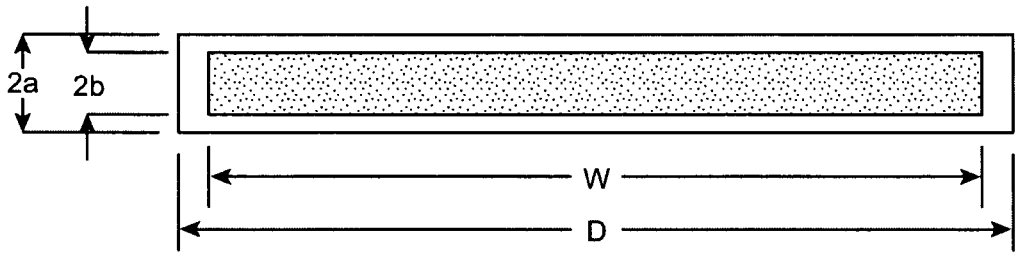
FIG. 3 is a diagram comparing a sheet beam with a circular beam.
Figure 3:
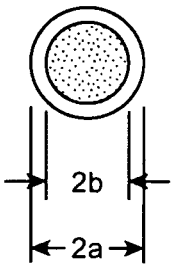

FIG. 3 is a diagram comparing a sheet beam with a circular beam that has a same thickness. In the figure, J is the beam current density and B is the magnetic flux density. It should be noted that the illustration is made with reference to some examples of operating parameters for the beam 44, and that embodiments described herein should not be limited to the examples shown. Providing the beam 44 with an elongate cross section has several advantageous. First, the beam 44 with an elongate cross section provides an increased surface area that supports higher peak and average power. Given the same beam voltage and current, the surface area of the beam tunnel and resonant cavities are larger in a sheet beam klystron than in a round beam klystron that produces a circular beam with a same thickness. Assuming the same beam thickness (height) for both round and elongate beams, then the aspect ratio of the elongate beam is also the ratio of beam areas. Also, for the same beam current, the elongate beam will have space charge defocusing forces (i.e., forces resulted from electrons that are bunched together) that are much less than that of the round beam. This will help reduce the magnetic field required to focus the beam. Further, the beam 44 with the elongate cross section may result in a lower impedance, but may still provide a same power compared to a circular beam with a same thickness.

Figure 4A:
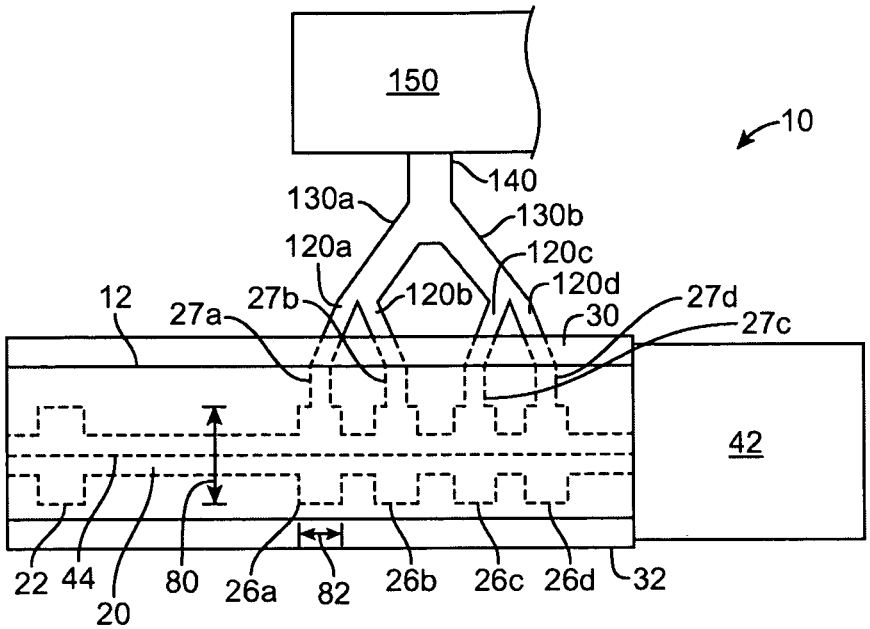
FIG. 4A illustrates a distal end of a klystron in accordance with some embodiments.

FIG. 4A illustrates the output section 17 of the structure 12 in accordance with some embodiments. As shown in the figure, the output section 17 includes the four output cavities 26*a*-26*d* with respective outputs 27*a*-27*d*. Each of the four cavities 26*a*-26*d* may have a unique resonant frequency. In the illustrated embodiments, each of the cavities 26 has an elongate shape (e.g., a rectangular shape). However, in other embodiments, each of the cavities 26 may have other shapes.

In the illustrated embodiments, each output cavity 26 has a rectangular cross section (when viewing the output cavity 26 from a side), with a vertical extent 80 that is longer than a horizontal extent 82. In other embodiments, each cavity 26 may have other cross sectional shapes, such as a square, a circular, an elliptical, or other customized shapes. Each output 27 has a thickness that is less than the horizontal extent 82 of the cavity 26. In other embodiments, each output 27 may have a thickness that is the same as the horizontal extent 82 of the cavity 26.

The output cavities 26*a*-26*d* are coupled, via outputs 27*a*-27*d*, respectively, to a waveguide 100, which is configured to transmit RF power from the output cavities 26*a*-26*b* to another device 150, such as an accelerator. In the illustrated embodiments, the waveguide 100 has a tree configuration. In particular, the waveguide 100 has a plurality of tubes 120*a*-120*d* coupled to respective output cavities 26*a*-26*b*. The tubes 120*a* and 120*b* are coupled to tube 130*a*, and the tubes 120*c* and 120*d* are coupled to tube 130*b*. The tubes 130*a*, 130*b* are, in turn, coupled to tube 140, which is configured to deliver RF energy to the device 150. Although only four output cavities 26*a*-26*d* are shown in the illustrated embodiments, in other embodiments, the klystron 10 may have less than four output cavities 26 (e.g., two output cavities 26) or more than four output cavities 26. Accordingly, in other embodiments, the klystron 10 may have less than four outputs 27 or more than four outputs 27, with the number of outputs 27 corresponding to the number of output cavities 26.

Figure 4B:
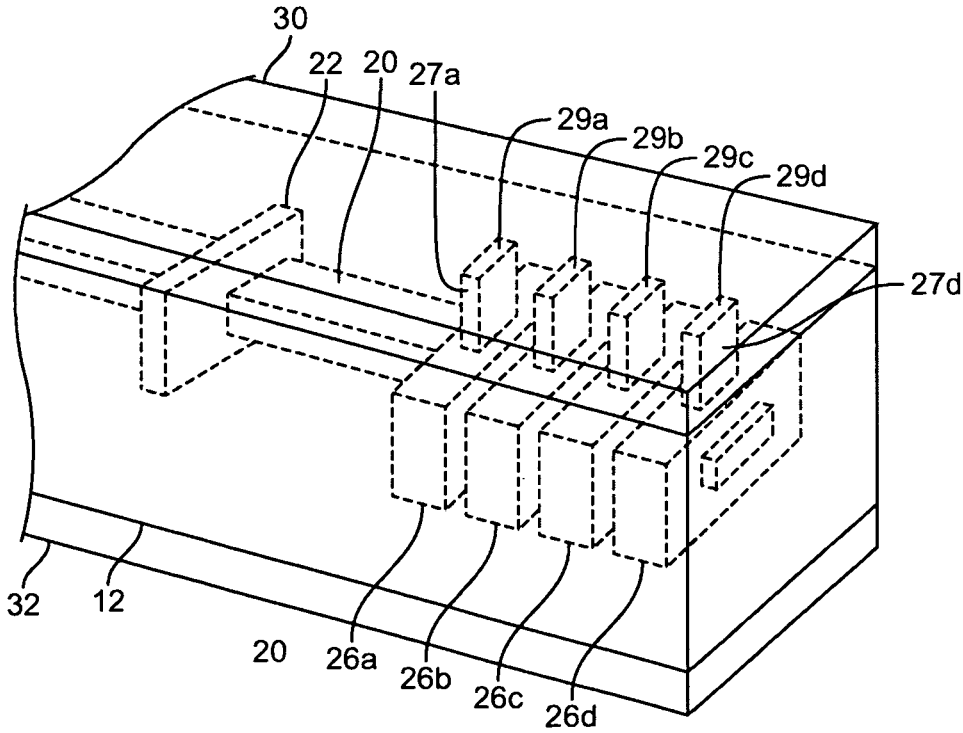
FIG. 4B illustrates a perspective view of the distal end of the klystron of FIG. 4A in accordance with some embodiments.

A perspective view of the device of FIG. 4A is shown in FIG. 4B. The component 42 and the waveguide 100 are omitted for clarity purpose. As shown in the figures, the outputs 27 of the output cavities 26 extend towards a top side of the structure 12. Such configuration may require the magnetic structure 30 to have one or more openings for accommodating the tubes 120*a*-120*d* that connect to the outputs 27*a*-27*d*, respectively.

Figure 5A:
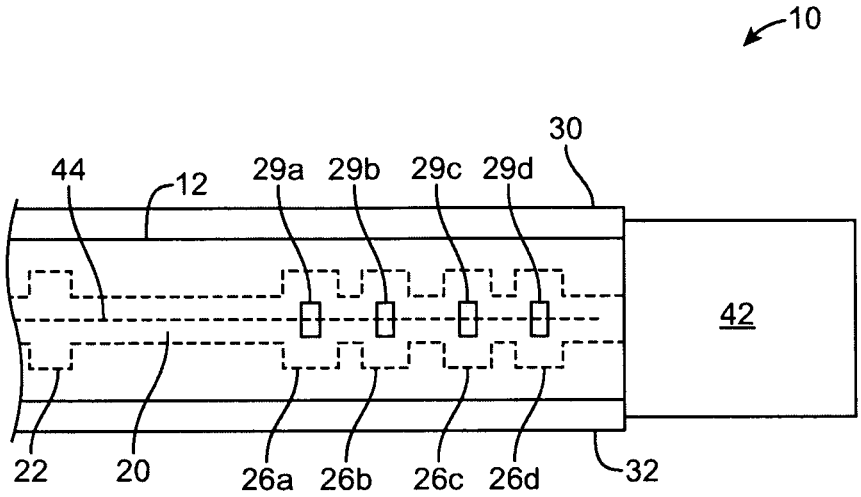
FIG. 5A illustrates a distal end of a klystron in accordance with other embodiments.
Figure 5B:
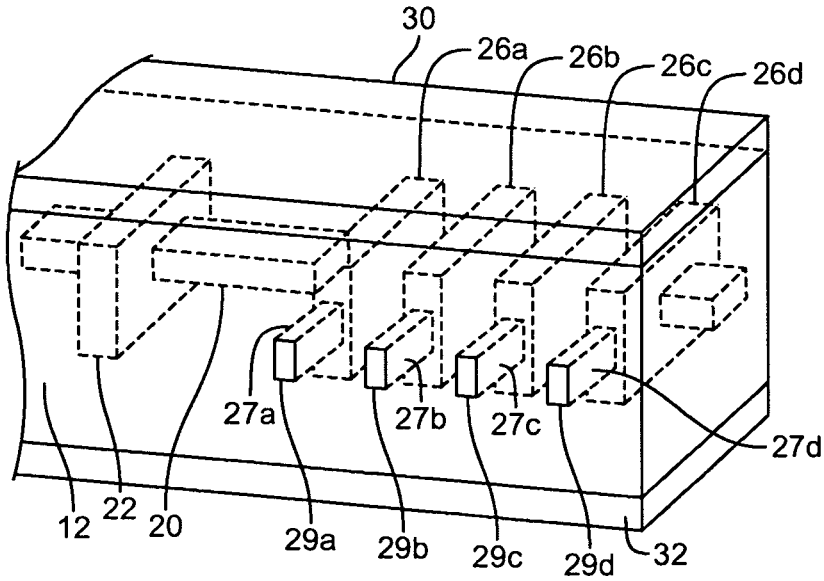
FIG. 5B illustrates a perspective view of the distal end of the klystron of FIG. 5A in accordance with some embodiments.

In other embodiments, the outputs 27*a*-27*d* of the output cavities 26 may extend towards a side of the structure 12, such as that shown in FIG. 5A (wherein the component 42 and the waveguide 100 are omitted for clarity). FIG. 5B illustrates a perspective view of the device of FIG. 5A. In the illustrated embodiments, because the outputs 27*a*-27*d* extend from the respective lateral sides of the respective output cavities 26, the waveguide 100 is coupled to the outputs 27 at a lateral side of the structure 12. Such configuration is advantageous in that it obviates the need to provide opening(s) at the magnetic structure 30 for accommodating the tubes 120 of the waveguide 100.

The klystron 10 is configured to amplify RF signals by converting the kinetic energy in the electron beam 44 into radio frequency power. During use of the klystron 10, the electron source 40 produces the electron beam 44 with an elongate cross section to form a sheet beam. The electron beam 44 is injected into the opening 20 of the structure 12, and is transmitted downstream along the length of the structure 12. A RF signal is fed into the input cavity 24 at or near its natural frequency to produce a voltage which acts on the electron beam 44, and the structure 12 functions as a high frequency circuit which interacts with the beam 44 of electrons to thereby velocity modulate the electron beam 44. As a result, electrons that pass through during an opposing electric field are accelerated and later electrons are slowed, thereby causing the electron beam 44 to form bunches at the input frequency, and resulting in current modulation. The resonant cavities 22*a*-22*d* are used to increase the current bunching to a desired level, e.g., a maximum value. The current bunches induce RF currents in the gap of each of the output cavities 26*a*-26*d*. The impedance of each of the output cavities 26*a*-26*d* produces a gap voltage, which decelerates the bunched electron beam 44 and converts the beam's kinetic energy into RF output power.

The developed RF energy is then coupled out from the output cavities 26*a*-26*d* via outputs 27*a*-27*d* at the output section 17 of the structure 12. In particular, the RF output power from the cavities 26*a*, 26*b* are delivered via outputs 27*a*, 27*b* to the tubes 120*a*, 120*b*, respectively, which transmit the power to the tube 130*a* to combine the RF power from the cavities 26*a*, 26*b*. Similarly, the RF output power from the cavities 26*c*, 26*d* are delivered via outputs 27*c*, 27*d* to the tubes 120*c*, 120*d*, respectively, which transmit the power to the tube 130*b* to combine the RF power from the cavities 26*c*, 26*d*. The tubes 130*a*, 130*b* in turn deliver the power to the tube 140 to thereby combine the power from the cavities 26*a*-26*d*. The combined RF power is then output to the device 150. The electron beam 44 downstream from the cavities 26*a*-26*d*, with reduced energy, is captured by the collector 42 distal to the output cavities 22*a*-22*d*.

In the illustrated embodiments, the outputs 27*a*-27*d* allow RF power to be separately extracted from each of the output cavities 26. Thus, instead of developing a single gap voltage that is equal to or greater than the DC beam voltage, the klystron 10 distributes the voltage used to decelerate the beam 44 over several output cavities 26*a*-26*d*. Since the ohmic loss in each output cavity 26 is proportional to $V^2/R$ (wherein V is voltage and R is resistance), splitting the total voltage $V_t$ into multiple cavities ($V_1+V_2+\ldots+V_n=V_t$) reduces the total ohmic loss ($V_t^2 >> (V_1^2+V_2^2+\ldots+V_n^2)$). Also, use of multiple output cavities 26 to extract RF power is beneficial in that the individual cavity impedances sum to give a higher total impedance (compared to that of single output cavity) and hence provides a better circuit efficiency. Therefore, the embodiments of the klystron 10 provide a significant advantage in performance over RF source with a single output cavity. When a single output cavity is used to output the RF energy, a large fraction of the output power is consumed in ohmic losses in the output cavity, resulting in a low circuit efficiency for the RF source. This is because the single resonant output cavity results in a high capacitance that reduces the cavity's impedance, and makes it difficult to develop adequate gap voltage in the gap of the single output cavity without compromising the circuit efficiency.

Figure 6A:
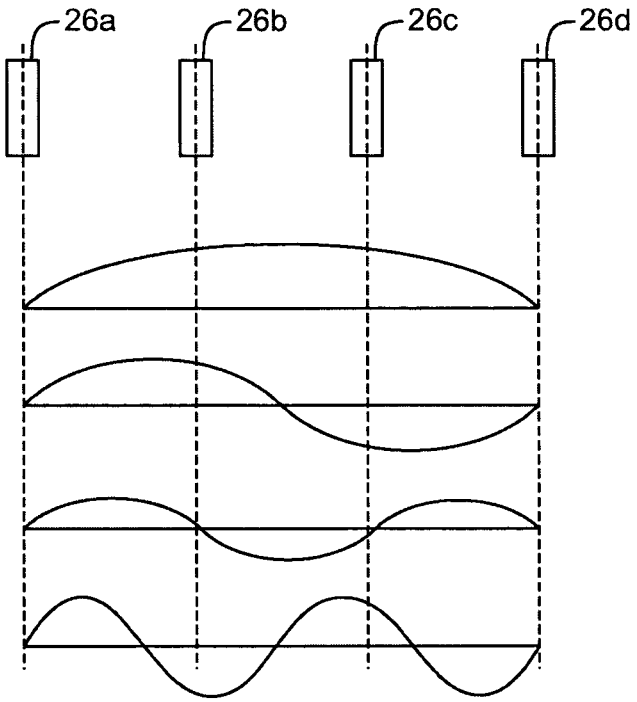
FIG. 6A illustrates four modes that are associated with four output cavities.
Figure 6B:
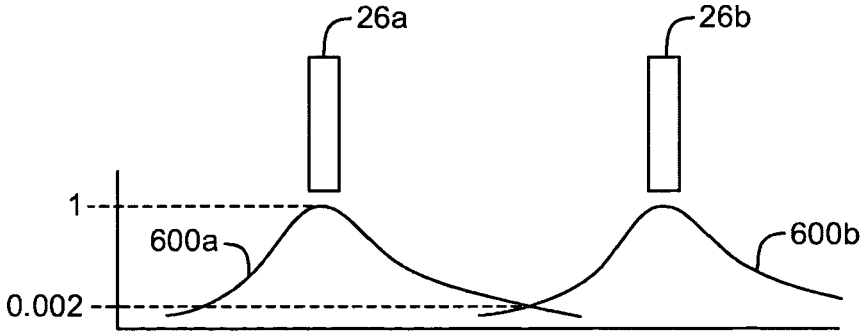
FIG. 6B illustrates separation of modes in accordance with some embodiments.

In the illustrated embodiments, the output cavities 26 (and their corresponding outputs 27) are spaced apart from each other such that they are electromagnetically uncoupled from each other. Electromagnetically uncoupling the output cavities 26 from each other allows the resonant frequencies of the output cavities 26 to be independent of one another, thereby preventing, or at least reducing, mode competition compared to output cavities that interact with each other. Competing modes are not desirable for the operation of the device 10 because energy generated in the second mode (and higher mode) may be lost and not captured by the device 10, thereby making the device 10 less efficient. FIG. 6A illustrates four modes that are present when the individual cavities are closely spaced (electromagnetically coupled) and the field from an individual gap couples strongly with neighboring gaps. In this case, the cavities 26*a*-26*d* are actually one extended interaction cavity with four possible mode patterns shown graphically in FIG. 6A. FIG. 6B illustrates separation of modes that is resulted from spacing apart the output cavities 26*a*-26*d* so that the field produced in one cavity does not couple to an adjacent cavity. As shown in FIG. 6B, two output cavities 26 are considered to be electromagnetically uncoupled from each other if they are spaced apart such that at least one of the respective curves 600*a*, 600*b*, representing the electric field vector in the direction of electron beam propagation, has a value of 1% or less, or more preferably 0.5% or less (e.g., 0.2%), of the maximum level at the midpoint between two output cavities. In the example, the maximum level is normalized to be 1, and the curve 600*a* has a value of 0.002 at the midpoint between the two output cavities 26*a*, 26*b*. In some embodiments, the output cavities 26 are separated from each other by an electron bunch phase value of at least 2π, and more preferably 4π Embodiments of the klystron 10 eliminate the risks (e.g., mode competition, oscillation, reduced efficiency) associated with undesired modes from extended-interaction output circuits. In some cases, providing uncoupled output cavities 26 allows many complicated factors associated with the design of the klystron 10 to be eliminated.

It should be noted that the uncoupling of output cavities 26 are suitable for beam with any cross sectional shape, but are especially beneficial for sheet beam. This is because in sheet beam, the impedance (i.e., that is associated with the response of the cavity to the bunches) may be significantly less than that for the circular beam. So providing a plurality of output cavities 26 would allow the device 10 to produce the required impedance to stop the beam. Thus, for the embodiments in which the klystron 10 is configured to generate a sheet beam, the reduced shunt impedance R/Q may make it desirable to use multiple output cavities to achieve sufficient voltage for slowing the beam. On the other hand, the electromagnetically uncoupled cavities may not be necessary in circular beam tubes because their interaction impedance may be high enough that only one cavity is required to decelerate the beam.

In some embodiments, the klystron 10 is configured to provide RF energy to an accelerator, in which case the device 150 is an accelerator, or a part of an accelerator. The accelerator may be a component of a medical device. For example, in some embodiments, the accelerator may be a part of a treatment device for delivering a treatment beam, such as x-ray, a proton beam, etc., for treating a patient. In other embodiments, the accelerator may be a part of a diagnostic device for delivering an imaging beam for imaging a portion of a patient. In still other embodiments, the accelerator may be a part of an object inspection device, such as a security system, for scanning object. In further embodiments, the klystron 10 may be used to produce low-power reference signals for superheterodyne radar receivers. In further embodiments, the klystron 10 may be used to produce high-power carrier waves for communications, in which case, the klystron 10 is a part of a communication system. In other embodiments, the klystron 10 may be a part of a radar system. In still further embodiments, the klystron 10 may be a part of a material processing system, e.g., for drying wood, curing ceramics, drying adhesives, cooking food or other industrial heating processes.

Figure 7:
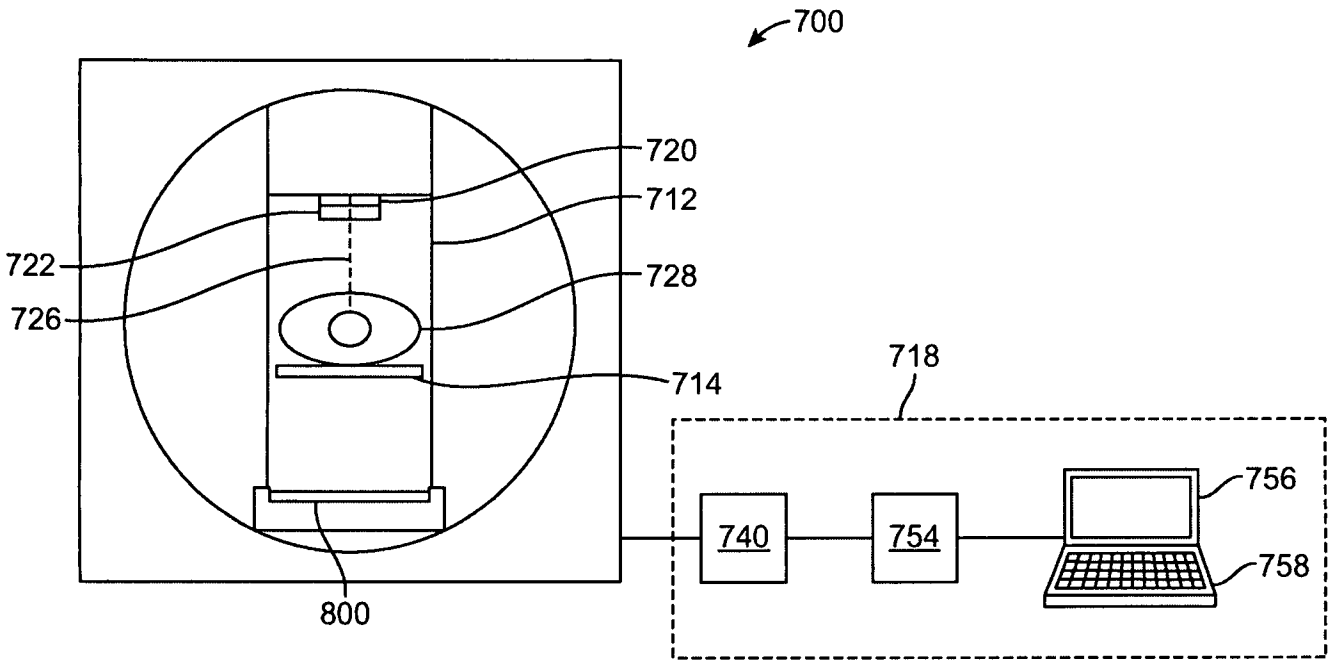
FIG. 7 illustrates a system for delivering radiation that includes a klystron in accordance with some embodiments.

FIG. 7 illustrates a radiation system 700 that utilizes the klystron 10 in accordance with some embodiments. The system 700 includes a gantry 712 (in the form of an arm), a patient support 714 for supporting a patient, and a control system 718 for controlling an operation of the gantry 712. The system 700 also includes a radiation source 720 that projects a beam 726 of radiation towards a patient 728 while the patient 728 is supported on support 714, and a collimator system 722 for controlling a delivery of the radiation beam 726. The radiation source 720 can be configured to generate a cone beam, a fan beam, or other types of radiation beams in different embodiments. In the illustrated embodiments, the radiation source 720 is coupled to the arm gantry 712. Alternatively, the radiation source 720 may be located within a bore.

In the illustrated embodiments, the control system 718 includes a processor 754, such as a computer processor, coupled to a control 740. The control system 718 may also include a monitor 756 for displaying data and an input device 758, such as a keyboard or a mouse, for inputting data. In the illustrated embodiments, the gantry 712 is rotatable about the patient 728, and during a treatment procedure, the gantry 712 rotates about the patient 728 (as in an arch-therapy). In other embodiments, the gantry 712 does not rotate about the patient 728 during a treatment procedure. In such case, the gantry 712 may be fixed, and the patient support 714 is rotatable. The operation of the radiation source 720, the collimator system 722, and the gantry 712 (if the gantry 12 is rotatable), are controlled by the control 740, which provides power and timing signals to the radiation source 720 and the collimator system 722, and controls a rotational speed and position of the gantry 712, based on signals received from the processor 754. Although the control 740 is shown as a separate component from the gantry 712 and the processor 754, in alternative embodiments, the control 740 can be a part of the gantry 712 or the processor 754.

Figure 8:
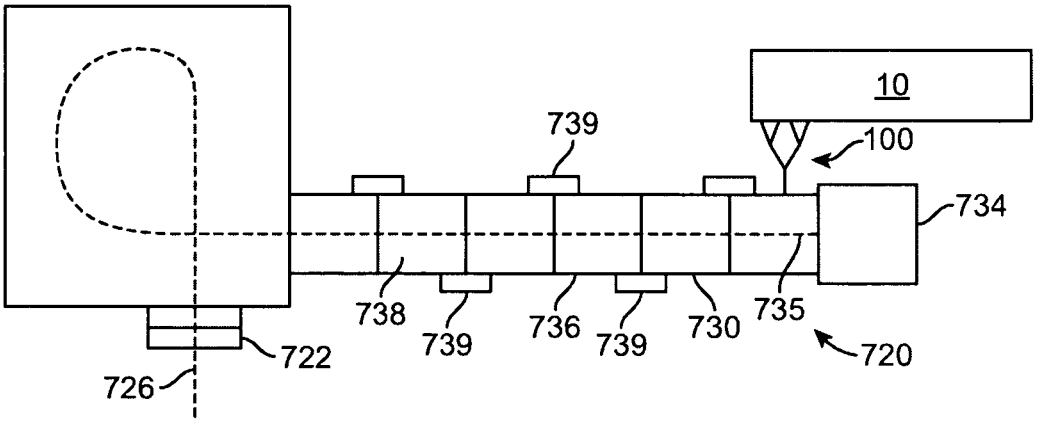
FIG. 8 illustrates the radiation source of FIG. 7 in accordance with some embodiments.

As shown in FIG. 8, the radiation source 720 includes an electron beam standing wave accelerator 730. The accelerator 730 includes an electron source 734 for generating electrons, and a main body 736 coupled to the electron source 734 for bunching and accelerating the electrons. The main body 736 includes a plurality of cavities 738 (electromagnetically coupled resonant cavities) that are coupled in series. The accelerator 730 also includes a plurality of coupling bodies 739, each of which having a coupling cavity (not shown) that electromagnetically couples to two adjacent resonant cavities via irises or openings. Although the coupling bodies 739 are illustrated as side coupling bodies that are coupled to sides of the main body 736, in other embodiments, the coupling bodies 739 can be implemented as on-axis coupling cells to reduce the overall profile of the accelerator 730. During use, the electron source 734 generates electrons 735, and injects them into the accelerator 730. The standing wave accelerator 730 is excited by microwave power delivered by the klystron 10 at a frequency near its resonant frequency, for example, between 1000 MHz and 20 GHz, and more preferably, between 2800 and 3000 MHz. The klystron 10 may be any of the embodiments of the klystron 10 described herein. The RF power from the klystron 10 enters one of the resonant cavities 738 along the chain, through an opening (not shown). As a result, standing waves are induced in the resonant cavities 738 by the applied RF energy. The excited accelerator 730 accelerates the electrons 735, which interact with a target material (not shown) to generate the radiation beam 726. As shown in the figure, the electron beam 735 is deflected using magnets (not shown) so that it is transmitted towards a desired direction.

In the illustrated embodiments, the radiation source 720 is a treatment radiation source for providing treatment energy. In other embodiments, in addition to being a treatment radiation source, the radiation source 720 can also be a diagnostic radiation source for providing diagnostic energy. In such cases, the system 700 will include an imager, such as the imager 800, located at an operative position relative to the source 720 (e.g., under the support 714). In some embodiments, the treatment energy is generally those energies of 160 kilo-electron-volts (keV) or greater, and more typically 1 mega-electron-volts (MeV) or greater, and diagnostic energy is generally those energies below the high energy range, and more typically below 160 keV. In other embodiments, the treatment energy and the diagnostic energy can have other energy levels, and refer to energies that are used for treatment and diagnostic purposes, respectively. In some embodiments, the radiation source 720 is able to generate X-ray radiation at a plurality of photon energy levels within a range anywhere between approximately 10 keV and approximately 20 MeV. In further embodiments, the radiation source 720 can be a diagnostic radiation source.

It should be noted that the radiation system 700 may have different configurations in different embodiments, and that embodiments of the klystron 10 may be used with radiation systems that are different from the example shown.

Although the electromagnetically uncoupled output cavities 26 have been described with reference to the klystron 10 (which may be considered a type of RF source), in other embodiments, the electromagnetically uncoupled output cavities 26 may be provided for other devices. For example, in other embodiments, the electromagnetically uncoupled output cavities 26 may be parts of a RF source, such as an inductive output tube (IOT), which may or may not be considered a klystron.

In further embodiments, the electromagnetically uncoupled output cavities 26, and/or the sheet beam feature, may be part of an active denial system (ADS), which is a non-lethal weapon that may be used for crowd control. The ADS is configured to direct electromagnetic radiation, such as high-frequency microwave radiation at a certain frequency (e.g., 95 GHz at wavelength of 3.2 mm) toward a person, or persons. The waves excite water molecules in the epidermis to a high temperature (e.g., 55° C.) to thereby cause the person(s) to feel intense pain without injuring the person(s). In some cases, the focused beam can be directed at the person(s) from a distance that is anywhere from 1 yard to 500 yards away. In other embodiments, the focused beam may be directed at the person(s) from a distance that is more than 500 yards away. In some embodiments, the uncoupled output cavities 26, and/or the sheet beam feature, may be part of a microwave generator for generating high-frequency microwave radiation, wherein the microwave generator is a component of the ADS. The output radiation from the klystron is fed to a high gain antenna such as a parabolic antenna. The antenna focuses the radiation into a narrow beam that can be precisely positioned on target. The advantage of using a sheet beam klystron over the current RF source for ADS is that the startup time for the klystron is related to the time to heat the cathode in the electron gun. This is advantageous over existing ADS sources that require long cool down times for cryogenic beam focusing magnets, in excess of 12 hours before the device is ready to operate.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

What is claimed:

1. A RF generator for providing energy to an accelerator, comprising:

a structure having an input section, an output section, and an opening extending between the input section and the output section;

wherein the output section has a first cavity and a second cavity that are configured to deliver RF energy to the accelerator, wherein the first and second cavities are spaced apart from each other so that they are electromagnetically uncoupled from each other, and wherein the first and second cavities are considered to be electromagnetically uncoupled from each other when an electric field vector associated with the first cavity has a value at a position that is 1% or less of a maximum value, the position being equal distance from the first and second cavities.

2. The RF generator of claim 1, wherein the electric field vector associated with the first cavity is in a direction of an electron beam propagation.

3. The RF generator of claim 2, wherein the value of the electric field vector at the position is at most 0.2% of the maximum value.

4. The RF generator of claim 1, wherein the first and second cavities are spaced apart from each other by an electron bunch phase value of at least $2\pi$.

5. The RF generator of claim 4, wherein the electron bunch phase value is at least $4\pi$.

6. The RF generator of claim 1, further comprising a waveguide coupled to the output section, wherein the waveguide is for delivering the RF energy to the accelerator.

7. The RF generator of claim 6, wherein the waveguide has a tree configuration.

8. The RF generator of claim 1, further comprising an electron source coupled to the structure, wherein the electron source is configured to provide an electron beam having an elongate cross section.

9. The RF generator of claim 8, wherein the opening of the structure is axially aligned with the electron source.

10. The RF generator of claim 1, further comprising a depressed collector coupled to the structure.

11. The RF generator of claim 1, wherein the opening has an elongate cross section.

12. The RF generator of claim 11, wherein the opening has a rectangular cross section.

13. The RF generator of claim 1, further comprising a plurality of resonant cavities in communication with the opening.

14. The RF generator of claim 1, further comprising:

a first tube coupled to the first cavity; and a second tube coupled to the second cavity.

15. The RF generator of claim 14, further comprising a third tube coupled to the first and second tubes.

16. The RF generator of claim 1, further comprising:

a third cavity at the output section; and a fourth cavity at the output section;

wherein the third and fourth cavities are uncoupled from each other.

17. The RF generator of claim 16, further comprising:

a first tube coupled to the first cavity;

a second tube coupled to the second cavity;

a third tube coupled to the third cavity; and a fourth tube coupled to the fourth cavity.

18. The RF generator of claim 17, further comprising:

a fifth tube coupled to the first and second tubes; and a sixth tube coupled to the third and fourth tubes.

19. A system comprising the RF generator of claim 1, and the accelerator.

20. The RF generator of claim 19, wherein the accelerator is a part of an object inspection device.

21. The RF generator of claim 19, wherein the accelerator is a part of a radiation system for treating or imaging a patient.

22. The RF generator of claim 1, wherein the opening has a longitudinal axis extending therethrough, and the first cavity and the second cavity are located along the longitudinal axis.

23. The RF generator of claim 1, wherein the first and second cavities are configured to deliver the RF energy to the accelerator in parallel.

24. A method of providing RF energy to an accelerator, comprising:

receiving an electron beam;

providing a first RF energy to the accelerator through a first cavity, wherein the first RF energy is generated using the electron beam; and providing a second RF energy to the accelerator through a second cavity, wherein the second RF energy is generated using the electron beam;

wherein the first cavity and the second cavity are spaced apart from each other so that they are electromagnetically uncoupled from each other, and wherein the first and second cavities are considered to be electromagnetically uncoupled from each other when an electric field vector associated with the first cavity has a value at a position that is 1% or less of a maximum value, the position being equal distance from the first and second cavities.

25. The method of claim 24, wherein the electric field vector associated with the first cavity is in a direction of an electron beam propagation.

26. The method of claim 25, wherein the value of the electric field vector at the position is at most 0.2% of the maximum value.

27. The method of claim 24, wherein the first and second cavities are spaced apart from each other by an electron bunch phase value of at least $2\pi$.

28. The method of claim 27, wherein the electron bunch phase value is at least $4\pi$.

29. The method of claim 24, wherein the electron beam has an elongate cross section.

30. The method of claim 29, wherein the electron beam has a rectangular cross section.

31. The method of claim 24, further comprising combining the first and second RF energies.

32. The method of claim 31, wherein the first and second RF energies are combined into a combined energy before the combined energy is delivered to the accelerator.

33. The method of claim 24, wherein the accelerator is a part of an object inspection device.

34. The method of claim 24, wherein the accelerator is a part of a radiation system for treating or imaging a patient.

35. The method of claim 24, wherein the first cavity and the second cavity are parts of a RF generator that includes an input section, an output section, and an opening extending between the output and input sections, the opening has a longitudinal axis extending therethrough, the first cavity and the second cavity are at the output section of the RF generator, and the first cavity and the second cavity are located along the longitudinal axis.

36. The method of claim 35, wherein the opening has a longitudinal cross section.

37. The method of claim 24, wherein the first RF energy and the second RF energy are provided in parallel to the accelerator through the first and second cavities.

* * * * *